US010040648B2

(12) United States Patent
Takai et al.

(10) Patent No.: US 10,040,648 B2
(45) Date of Patent: Aug. 7, 2018

(54) SHEET STORAGE DEVICE, IMAGE FORMING APPARATUS

(71) Applicant: KYOCERA Document Solutions Inc., Osaka-shi, Osaka (JP)

(72) Inventors: Hiroaki Takai, Osaka (JP); Koki Morizono, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 11 days.

(21) Appl. No.: 15/456,114

(22) Filed: Mar. 10, 2017

(65) Prior Publication Data

US 2017/0275108 A1 Sep. 28, 2017

(30) Foreign Application Priority Data

Mar. 25, 2016 (JP) ..... 2016-061176

(51) Int. Cl.

| | |
|---|---|
| ***B65H 1/24*** | (2006.01) |
| ***B65H 1/26*** | (2006.01) |
| ***B65H 1/08*** | (2006.01) |
| ***G03G 15/00*** | (2006.01) |

(52) U.S. Cl.

CPC ..... *B65H 1/24* (2013.01); *B65H 1/08* (2013.01); *B65H 1/266* (2013.01); *G03G 15/6502* (2013.01); *B65H 2701/1916* (2013.01)

(58) Field of Classification Search

CPC .. B65H 2701/1916; B65H 1/08; B65H 1/266; B65H 1/24

See application file for complete search history.

(56) References Cited

U.S. PATENT DOCUMENTS

| | | | | |
|---|---|---|---|---|
| 5,823,522 | A * | 10/1998 | Fujiwara | G06K 13/16 271/145 |
| 7,967,287 | B2 * | 6/2011 | Hamasaki | B65H 1/266 271/171 |
| 8,191,891 | B2 * | 6/2012 | Yamagata | B65H 1/266 271/148 |
| 8,827,262 | B2 * | 9/2014 | Itabashi | B65H 1/266 271/148 |
| 9,272,857 | B2 * | 3/2016 | Nakagawa | B65H 1/12 |
| 9,434,561 | B2 * | 9/2016 | Nakagawa | B65H 1/266 |
| 2015/0191321 | A1 * | 7/2015 | Nakagawa | B65H 1/12 271/160 |
| 2015/0375955 | A1 * | 12/2015 | Kanematsu | B65H 43/00 271/2 |

(Continued)

FOREIGN PATENT DOCUMENTS

JP 2015129044 A 7/2015

*Primary Examiner* — Patrick Cicchino

(74) *Attorney, Agent, or Firm* — Alleman Hall Creasman & Tuttle LLP

(57) ABSTRACT

A sheet storage device includes a case, a lift plate, and a lift attachment. The lift attachment is fixed, in a detachable manner, to a central portion of the lift plate in a width direction. The lift attachment supports a lower surface of the sheets stacked on the lift plate at a position higher than the upper surface of the lift plate. The lift attachment includes a base portion and a pair of arm portions. The pair of arm portions are respectively formed to extend from an end portion of the base portion that is on a downstream side in the sheet feed direction, to opposite directions in the width direction.

10 Claims, 5 Drawing Sheets

(56) References Cited

U.S. PATENT DOCUMENTS

| | | | | |
|---|---|---|---|---|
| 2016/0200529 | A1* | 7/2016 | Kimura | B65H 1/14<br>271/2 |
| 2016/0200530 | A1* | 7/2016 | Kimura | B65H 1/14<br>271/2 |

* cited by examiner

SHEET STORAGE DEVICE, IMAGE FORMING APPARATUS

INCORPORATION BY REFERENCE

This application is based upon and claims the benefit of priority from the corresponding Japanese Patent Application No. 2016-061176 filed on Mar. 25, 2016, the entire contents of which are incorporated herein by reference.

BACKGROUND

The present disclosure relates to a sheet storage device and an image forming apparatus including thereof.

A typical image forming apparatus includes a sheet storage device that stores sheets that are fed by a sheet feed portion including a pick-up roller. The sheet storage device is provided as a sheet cassette which is attached to a main body of the image forming apparatus in a detachable manner.

In many cases, the sheet storage device includes a lift portion that is configured to be lifted and lowered, and push up stacked sheets toward the sheet feed portion that is provided above.

In addition, the sheet storage device may include a lift attachment that is attached to the lift portion in a detachable manner. The lift attachment is attached to the lift portion when a special sheet, such as an envelope, that is nonuniform in thickness, is stored in the sheet storage device.

SUMMARY

A sheet storage device according to an aspect of the present disclosure stores sheets that are fed by a sheet feed portion, and includes a case, a lift plate, and a lift attachment. The case stores the sheets. The lift plate is provided on a bottom plate of the case in such a way as to be lifted and lowered, and configured to push up the sheets stacked on an upper surface of the lift plate toward the sheet feed portion that is provided above. The lift attachment is fixed, in a detachable manner, to an end portion of an upper surface of the lift plate on a downstream side in a sheet feed direction, at a central portion of the upper surface in a width direction, and configured to support a lower surface of the sheets stacked on the lift plate at a position higher than the upper surface of the lift plate, the width direction being perpendicular to the sheet feed direction. The lift attachment includes a base portion and a pair of arm portions. The base portion is formed to extend along the sheet feed direction, and smaller than the lift plate in size in the width direction. The pair of arm portions are respectively formed to extend from an end portion of the base portion that is on a downstream side in the sheet feed direction, to opposite directions in the width direction, along an edge of the lift plate that is on the downstream side in the sheet feed direction.

An image forming apparatus according to another aspect of the present disclosure includes the sheet storage device, a sheet feed portion, and an image forming portion. The sheet feed portion feeds the sheets stored in the sheet storage device one by one into a sheet conveyance path. The image forming portion forms an image on a sheet that has been fed into the sheet conveyance path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Image Forming Apparatus 10]

Figure 1:
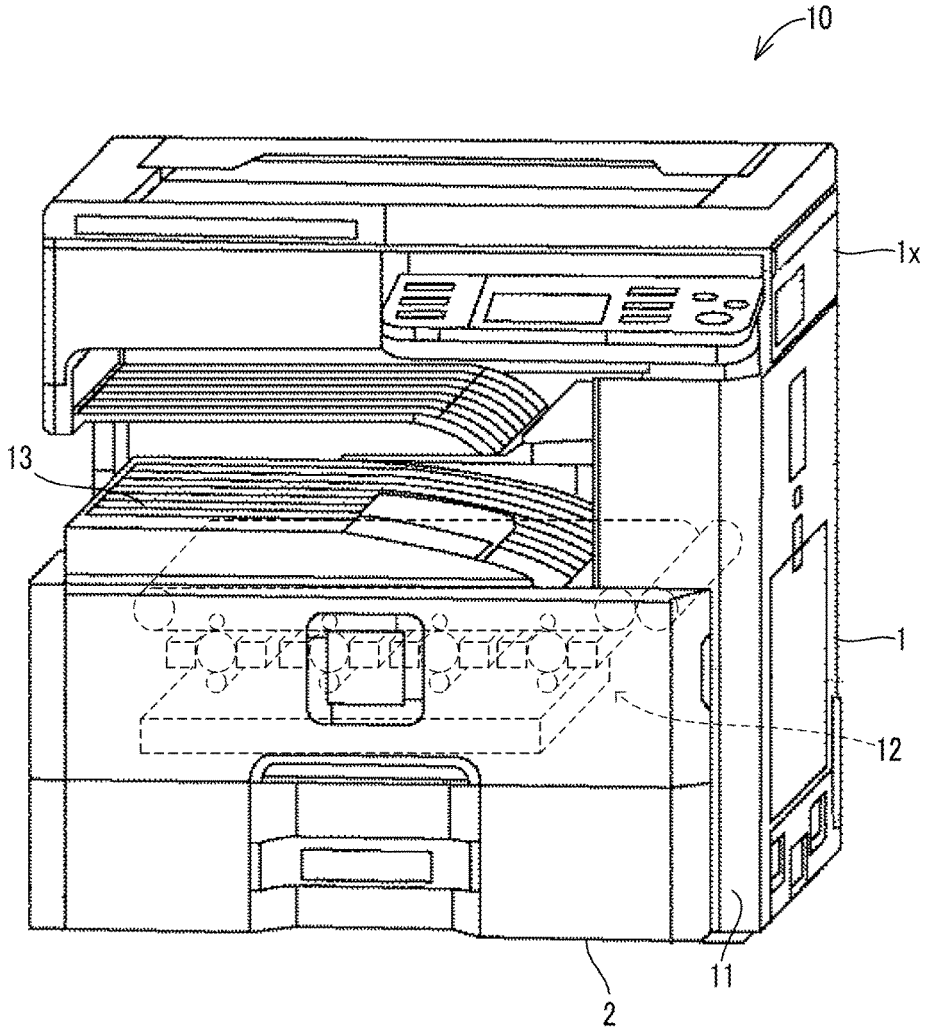
FIG. 1 is a perspective view of an image forming apparatus that includes a sheet storage device according to an embodiment of the present disclosure.

As shown in FIG. 1, the image forming apparatus 10 includes a main body 1 and a sheet storage device 2 according to the embodiment of the present disclosure. The image forming apparatus 10 is, for example, a printer, a copier or a multifunction peripheral. The image forming apparatus 10 shown in FIG. 1 is a multifunction peripheral including an image reading portion 1*x* disposed in an upper portion of the main body 1.

The sheet storage device 2 is a so-called sheet cassette. A lower portion of the main body 1 constitutes a device attachment portion 11 to which the sheet storage device 2 is attached in a detachable manner. The sheet storage device 2 is drawably attached to the device attachment portion 11. The sheet storage device 2 stores sheets 9 that are fed one by one by a sheet feed portion 14 provided in the device attachment portion 11 (see FIG. 3).

The sheet feed portion 14 includes a pick-up roller 14*a*, a fed sheet guide 14*b*, and a pair of feed rollers 14*c*. The pick-up roller 14*a* feeds the topmost one of the sheets 9 stacked in the sheet storage device 2 toward the pair of feed rollers 14*c*.

The fed sheet guide 14*b* supports the pick-up roller 14*a*, and guides the sheet 9 from under the pick-up roller 14*a* toward the pair of feed rollers 14*c*. The pair of feed rollers 14*c* feed the sheet 9 sent from the pick-up roller 14*a*, into a sheet conveyance path 15 in the main body 1.

In the following description, a direction in which a sheet 9 in the sheet storage device 2 is fed by the sheet feed portion 14 is referred to as a feed direction D0, and a horizontal direction perpendicular to the feed direction D0 is referred to as a width direction D1.

The main body 1 includes an image forming portion 12 which is configured to form an image on a sheet 9 fed from the sheet storage device 2 into the sheet conveyance path 15. The image forming portion 12 forms an image on the sheet 9, and discharges the sheet 9 after image formation to a discharge tray 13 that is provided between the main body 1 and the image reading portion 1*x*.

Figure 3:
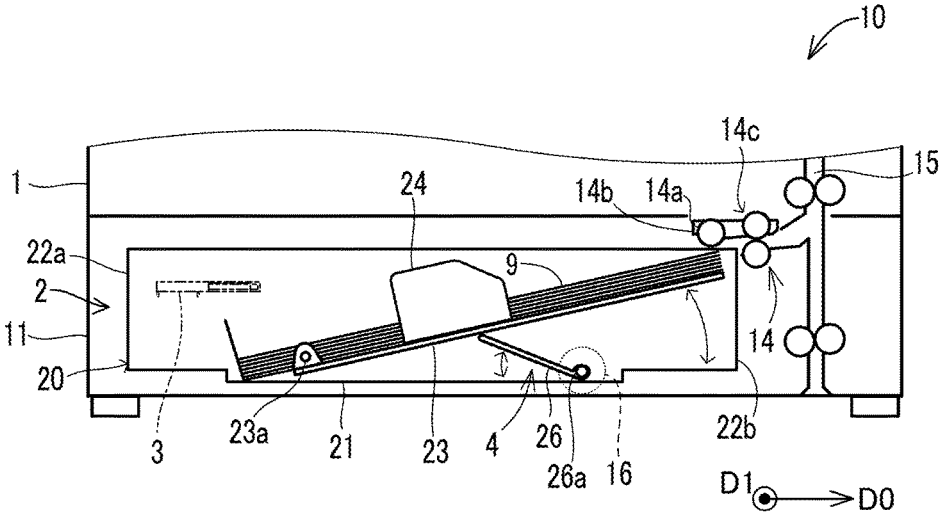
FIG. 3 is a configuration diagram of the sheet storage device according to the embodiment.

The sheet storage device 2 includes a case 20, a lift portion 23, and a lift supporting portion 26. As shown in FIG. 3, the lift portion 23 is plate-like, and is called a lift plate. The case 20 is made of synthetic resin and stores the sheets 9. The pick-up roller 14*a* rotates upon contact with an upper surface of the sheets 9 in the case 20, thereby feeding a sheet 9 from the case 20.

Figure 2:
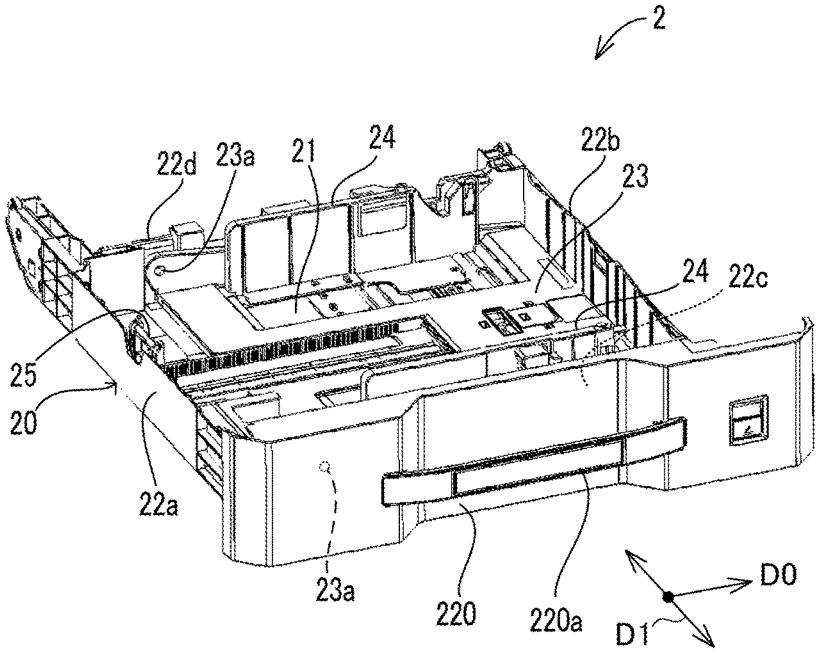
FIG. 2 is a perspective view of the sheet storage device according to the embodiment.

As shown in FIG. 2, the case 20 includes a bottom plate portion 21, and four side wall portions 22*a* to 22*d*. The four side wall portions 22*a* to 22*d* include a first side wall portion 22*a* and a second side wall portion 22*b* that are respectively located on the downstream side and the upstream side in the feed direction D0, and a third side wall portion 22*c* and a fourth side wall portion 22*d* that are respectively located at one end portion and the other end portion of opposite end portions in the width direction D1. An exterior member 220 provided with a handle 220*a* is attached to the third side wall portion 22*c*.

A pair of lateral guides 24 are attached to the bottom plate portion 21. The pair of lateral guides 24 are respectively applied to opposite ends of the sheets 9 in the width direction D1 in the case 20. Furthermore, a rear end stopper 25 is attached to the bottom plate portion 21. The rear end stopper 25 is applied to a rear end of the sheets 9. It is noted that the rear end of the sheets 9 is an end located on the upstream side in the feed direction D0.

The pair of lateral guides 24 are attached to the bottom plate portion 21 so as to be displaced along the width direction D1 by a rack and pinion mechanism. When one of the pair of lateral guides 24 is displaced along the width direction D1, the other lateral guide 24 is displaced in the opposite direction by the act of the rack and pinion, by the same displacement amount. In addition, the rear end stopper 25 is attached so as to be displaced along the feed direction D0 with respect to the lift portion 23.

The lift portion 23 is provided on the bottom plate portion 21 of the case 20 in such a way as to be lifted and lowered, and push up the stacked sheets 9 toward the pick-up roller 14*a* of the sheet feed portion 14 that is provided above. The lift portion 23 is made of a metal, for example.

The lift portion 23 is supported so as to be pivoted in the up-down direction with a pair of shaft portions 23*a* as a fulcrum, the pair of shaft portions 23*a* being located close to the first side wall portion 22*a* of the case 20.

The lift supporting portion 26 is supported by the case 20 so as to pivot in the up-down direction, and supports the lift portion 23 from below. When the sheet storage device 2 is attached to the device attachment portion 11, a driving shaft 26*a* at the base of the lift supporting portion 26 is coupled with a shaft of a lift motor 16 provided in the device attachment portion 11 by a gear mechanism (not shown). The driving shaft 26*a* is rotated by a power of the lift motor 16.

When the lift motor 16 rotates in a forward rotation direction, the lift supporting portion 26 pivots in a first direction around the driving shaft 26*a*, thereby causing the lift portion 23 to pivot toward the sheet feed portion 14. On the other hand, when the lift motor 16 rotates in a reverse rotation direction, the lift supporting portion 26 pivots in a second direction around the driving shaft 26*a*, thereby causing the lift portion 23 to pivot downward.

The sheet storage device 2 includes a lift attachment 3 that is represented by an imaginary line (a two-dot chain line) in FIG. 3. The lift attachment 3 is attached to the lift portion 23 in a detachable manner. The lift attachment 3 is attached to the lift portion 23 when a special sheet 90, such as an envelope, that is nonuniform in thickness, is stored in the sheet storage device 2 (see FIG. 9). The lift attachment 3 is described in detail below.

Meanwhile, to meet the demand for space saving and cost reduction, it is required to realize, in a simple configuration, the sheet storage device 2 that can accommodate both regular sheets 9 that are uniform in thickness, and special sheets 90 such as envelopes. In the following, a configuration of the sheet storage device 2 corresponding to such a request is described.

Figure 8:
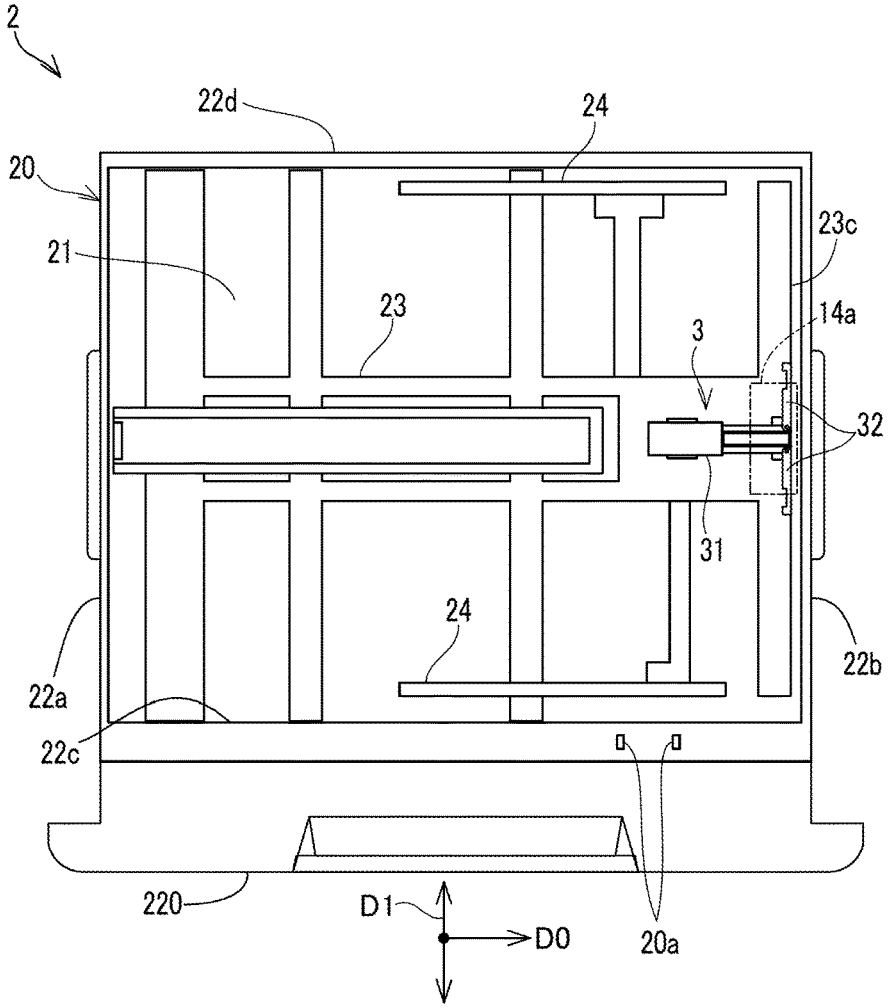
FIG. 8 is a plan view of the sheet storage device according to the embodiment in a state where the lift attachment is attached to the lift portion.

As shown in FIG. 8, the lift attachment 3 is made of synthetic resin and fixed to a central portion of the lift portion 23 in the width direction D1. Attached to the upper surface of the lift portion 23, the lift attachment 3 supports the lower surface of the sheets 9 stacked on the lift portion 23, at a position higher than the upper surface of the lift portion 23.

Figure 4:
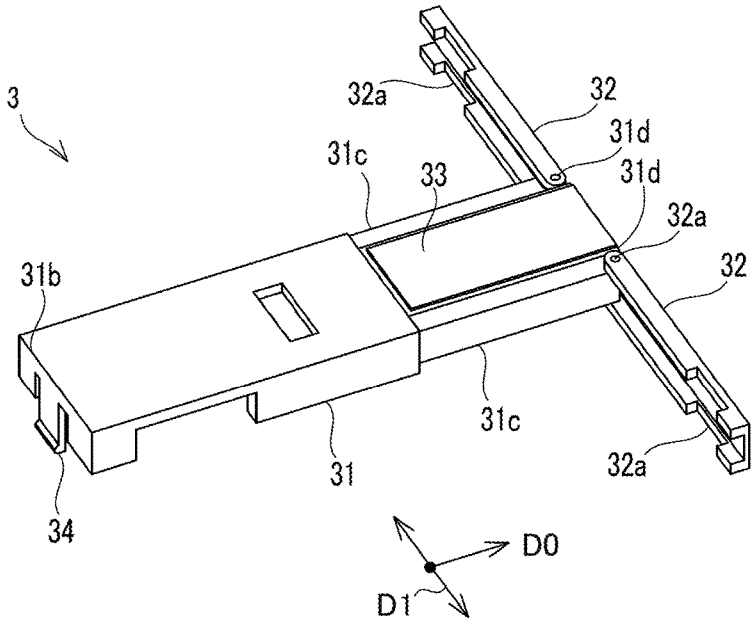
FIG. 4 is a perspective view of a lift attachment in an extended state, the lift attachment being included in the sheet storage device according to the embodiment.
Figure 5:
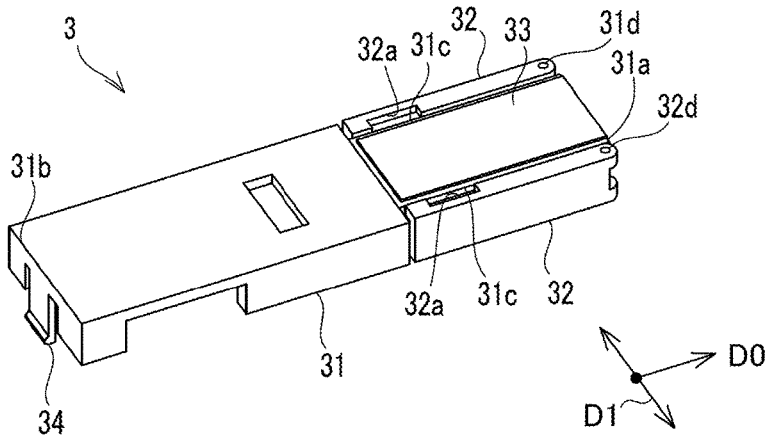
FIG. 5 is a perspective view, viewed from above, of the lift attachment in a folded state, the lift attachment being included in the sheet storage device according to the embodiment.
Figure 6:
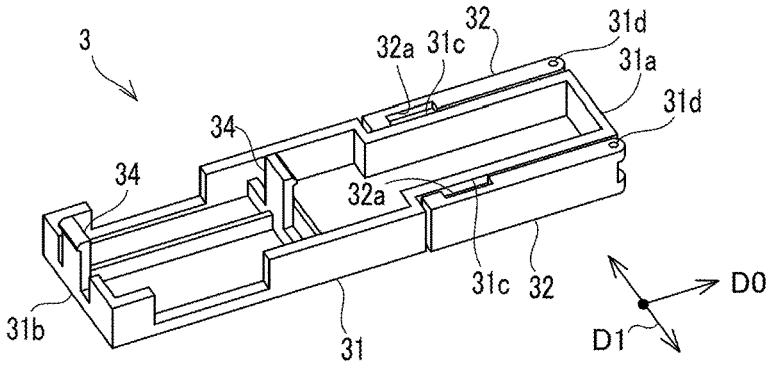
FIG. 6 is a perspective view, viewed from below, of the lift attachment in the folded state, the lift attachment being included in the sheet storage device according to the embodiment.

As shown in FIG. 4 to FIG. 6, the lift attachment 3 includes a base portion 31 and a pair of arm portions 32. In a state where the lift attachment 3 is attached to the lift portion 23, the base portion 31 is substantially rectangular parallelepiped-shaped extending along the feed direction D0. As shown in FIG. 8, the base portion 31 is smaller than the lift portion 23 in size in the width direction D1. A friction pad 33 is stuck on the upper surface of the base portion 31.

Figure 7:
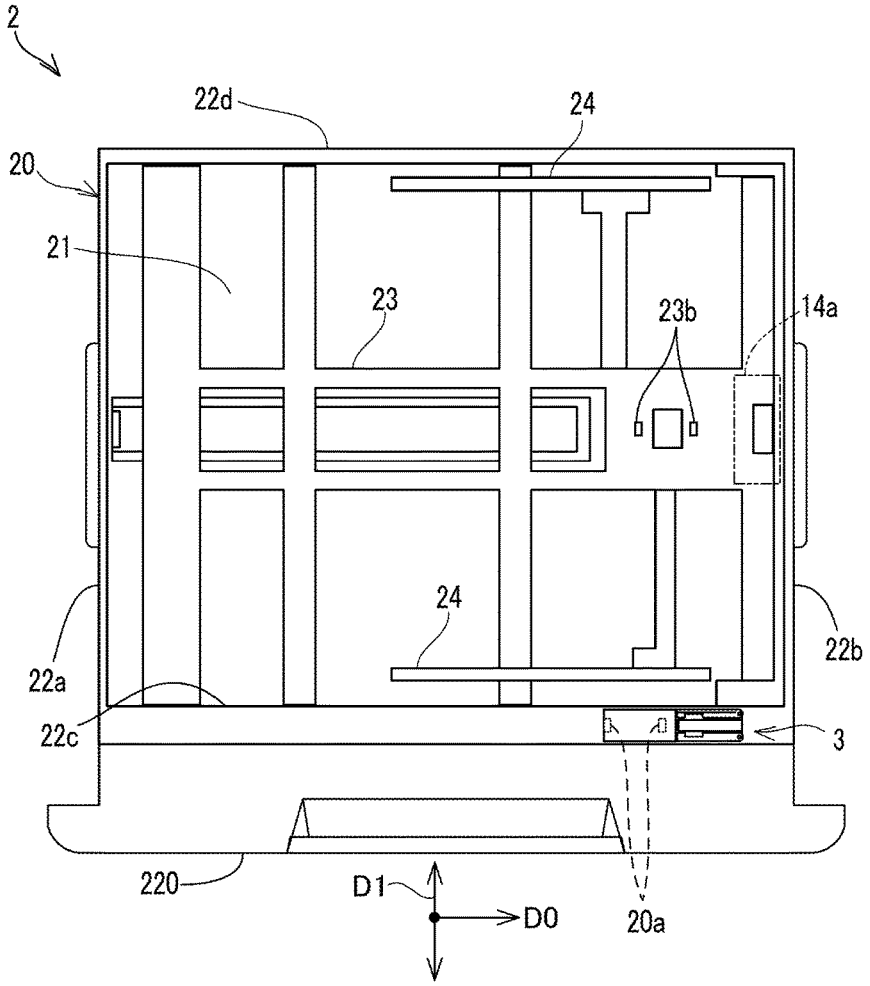
FIG. 7 is a plan view of the sheet storage device according to the embodiment in a state where the lift attachment is fastened in a housing position.

As shown in FIG. 7, two attachment holes 23*b* are formed in the lift portion 23. In addition, as shown in FIG. 6, two engaging portions 34 are formed on the base portion 31, wherein the engaging portions 34 are protruding so as to be hooked to rear-side rims of the two attachment holes 23*b* of the lift portion 23.

When the lift attachment 3 is attached to or detached from the lift portion 23, the root portions of the engaging portions 34 are elastically deformed. This allows the engaging portions 34 to be displaced between a position to be hooked to the rims of the attachment holes 23*b* of the lift portion 23, and a position to pass over the attachment holes 23*b*.

In a state where the lift attachment 3 is attached to the lift portion 23, the pair of arm portions 32 extend from a first end portion 31*a* of the base portion 31 that is on the downstream side in the feed direction D0, to opposite directions in the width direction D1 (see FIG. 4, FIG. 8). The pair of arm portions 32 are formed along an edge 23*c* of the lift portion 23 that is on the downstream side in the feed direction D0. The pair of arm portions 32 are formed symmetrically with respect to the base portion 31 in the width direction D1.

The base portion 31 is smaller than the pick-up roller 14*a* in size in the width direction D1. As a result, the base portion 31 supports the sheets 9 from below in a range in the width direction D1 that constitutes a part of a range of contact in the width direction D1 where the pick-up roller 14*a* contacts the sheet 9. In addition, the pair of arm portions 32 have a role of extending the range of support in the width direction D1 for supporting the sheets 9 from below at a position on the downstream side in the feed direction D0. It is noted that as shown in FIG. 8, the pair of arm portions 32 in an extension position that is described below are larger than the pick-up roller 14*a* in size in the width direction D1.

Figure 9:
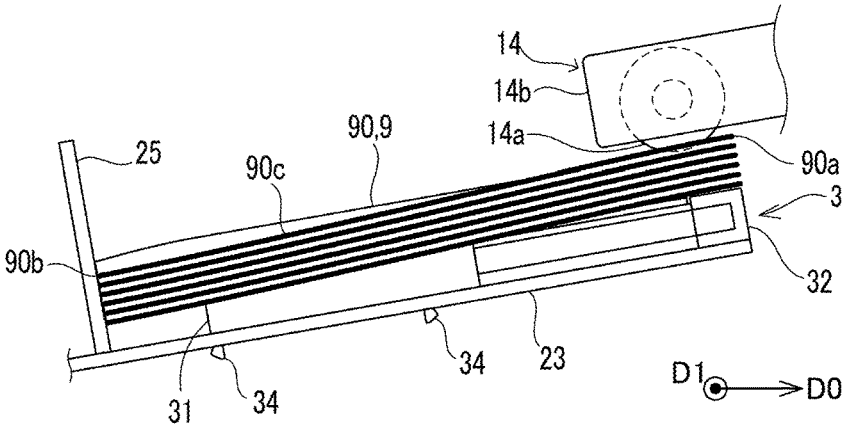
FIG. 9 is a schematic side view of a main part of the sheet storage device according to the embodiment in a state where special sheets are stored.

In the special sheet 90 such as an envelope, a side end portion 90*c* which is at one of opposite ends in the width direction D1, is thicker than the other portions (see FIG. 9). The lift attachment 3 is attached to the lift portion 23 when such special sheets 90 are stored in the sheet storage device 2. It is noted that the special sheets 90 are an example of the sheets 9 stored in the sheet storage device 2.

The upper surfaces of the base portion 31 and the pair of arm portions 32 support the lower surface of the lowest special sheet 90 of the stacked special sheets 90. The base portion 31 supports the lower surface of the special sheet 90 via the friction pad 33 stuck on the upper surface of the base portion 31.

As shown in FIG. 9, the pair of arm portions 32 support the lower surface of the stacked special sheets 90 at a portion close to a front end 90*a* of the stacked special sheets 90. That is, the pair of arm portions 32 in the extension position support an edge of the special sheets 90 on the downstream side in the feed direction D0. In addition, the base portion 31 supports the lower surface of the stacked special sheets 90 at the central portion of the special sheets 90 in the width direction D1, along the feed direction D0. A rear end 90*b* of the stacked special sheets 90 is supported by the rear end stopper 25.

The side end portion 90*c* of the special sheet 90 may be thicker than the other portions of the special sheet 90 in a case where the special sheet 90 is an envelope and the side end portion 90*c* includes a flap folded and overlapping the body portion of the envelope. In this case, when the special sheets 90 are stacked directly on a flat upper surface of the lift portion 23, the side end portion 90*c* of the topmost special sheet 90 is higher than the other portions. In such a situation, the special sheet 90 may not be fed out smoothly by the sheet feed portion 14 since a large frictional resistance is generated between the side end portion 90*c* and the fed sheet guide 14*b*.

On the other hand, as shown in FIG. 9, in a case where the special sheets 90 are placed on the lift attachment 3 attached to the lift portion 23, the side end portions 90*c* of the special sheets 90 in lower layers hang down a side of the fixing roller 31 in a region on the upstream side of the pair of arm portions 32 in the feed direction D0. With this configuration, the height of the side end portion 90*c* of the topmost special sheet 90 is suppressed, and the frictional resistance between the side end portion 90*c* and the fed sheet guide 14*b* is reduced. As a result, the special sheet 90 is fed out smoothly.

It is noted that the height of the side end portion 90*c* of the topmost special sheet 90 increases temporarily above the pair of arm portions 32. Here, the pair of arm portions 32 are located below the pick-up roller 14*a* or on the downstream side of the pick-up roller 14*a* in the feed direction D0. With this configuration, the side end portion 90*c* of the topmost special sheet 90 becomes temporarily high after passing an end portion of the fed sheet guide 14*b* on the upstream side in the feed direction D0. As a result, the frictional resistance between the side end portion 90*c* and the fed sheet guide 14*b* is reduced to a relatively small value.

The pair of arm portions 32 play a role of preventing a feeding error of special sheets 90 when a small number of special sheets 90 are placed on the lift attachment 3. This is described in the following.

As shown in FIG. 8, the base portion 31 is narrower than the pick-up roller 14*a* in width. It is noted that in FIG. 8, the pick-up roller 14*a* is represented by an imaginary line. If the lift attachment 3 does not include the pair of arm portions 32, when a small number of special sheets 90 are placed on the lift attachment 3, both sides of the central portion of the special sheet 90 supported by the base portion 31 of the lift attachment 3 hang down. This allows the pick-up roller 14*a* to contact only the central portion of the special sheets 90, which may cause a feeding error such as an oblique feed of the special sheet 90.

The pair of arm portions 32 are disposed directly below or near directly below the pick-up roller 14*a* to support the special sheets 90 from below in a wide range in the width direction D1. With this configuration, even when a small number of special sheets 90 are stacked on the lift attachment 3, a sufficient contact area is secured between the pick-up roller 14*a* and the topmost special sheet 90. This prevents a feeding error of the special sheet 90.

Furthermore, the pair of arm portions 32 prevent the special sheets 90 from being displaced in the width direction D1 due to deviation in weight between opposite sides of the special sheets 90 in the width direction D1.

In addition, as shown in FIG. 4 and FIG. 5, in the lift attachment 3, the pair of arm portions 32 are supported by the base portion 31 in such a way as to pivot between a folded position in which the arm portions 32 extend along two side edge portions 31*c* of the base portion 31 respectively, and the extension position in which the arm portions 32 extend in opposite directions from the first end portion 31*a* of the base portion 31 in the width direction D1. The side edge portions 31*c* are formed to extend along the feed direction D0. The pair of arm portions 32, in the extension position, respectively extend away from the side edge portions 31*c* along the width direction D1.

The pair of arm portions 32 are configured to pivot around support shafts 31*d* formed on corners in the first end portion 31*a* of the base portion 31, respectively. The lift attachment 3 is attached to the lift portion 23 in a state where the pair of arm portions 32 are in the extension position.

With the configuration where the pair of arm portions 32 are pivotably coupled with the base portion 31, it is possible to house the lift attachment 3 compactly when unused, without increasing the number of parts.

In addition, as shown in FIG. 8, two attachment holes 20*a* are formed in a frame portion provided outside a storage space of the sheets 9 in the case 20 so that the lift attachment 3 can be attached and fixed thereto in a detachable manner. In the present embodiment, the frame portion is the third side wall portion 22*c*.

When the two engaging portions 34 are inserted in the two attachment holes 20*a*, the lift attachment 3 is fixed to the third side wall portion 22*c* in a detachable manner. That is, the two engaging portions 34 serve as both a fastening mechanism for the lift portion 23, and a fastening mechanism for the case 20. It is noted that a portion of the third side wall portion 22*c* including the two attachment holes 20*a* is an example of the attachment housing portion.

As shown in FIG. 7, when unused, the lift attachment 3 is fixed to the third side wall portion 22*c* at a portion having the two attachment holes 20*a*, in a state where the pair of arm portions 32 are in the folded positions.

When the sheet storage device 2 is adopted, it is possible to deal with, with ease, both the sheets 9 that are uniform in thickness and the special sheets 90 such as envelopes by attaching and detaching the lift attachment 3. In addition, the lift attachment 3 can be produced by a relatively simple resin molding and has a simple configuration.

It is noted that the attachment holes 20*a* may be formed in an inner side surface of the exterior member 220. In this case, the exterior member 220 is an example of the frame portion.

In addition, since the lift attachment 3, when unused, is fixed to a part of the case 20, the lift attachment 3 is prevented from generating an abnormal sound when the sheet storage device 2 is attached or detached, or during carriage of the image forming apparatus 10.

APPLICATION EXAMPLES

The lift attachment 3 may be composed of two elemental members that are coupled in a separable manner. For example, a first elemental member may include the pair of arm portions 32 and a part of the base portion 31 between the arm portions 32, and a second elemental member may include the other portions of the lift attachment 3.

In the above-described case, a coupling mechanism similar to the engaging portions 34 and the attachment holes 23*b* may be formed in the first elemental member and the second elemental member.

It is noted that the sheet storage device and the image forming apparatus 10 of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet storage device storing sheets that are fed by a sheet feed portion, the sheet storage device comprising:

a case storing the sheets;

a lift plate provided on a bottom plate of the case in such a way as to be lifted and lowered, and configured to push up the sheets stacked on an upper surface of the lift plate toward the sheet feed portion that is provided above; and a lift attachment fixed, in a detachable manner, to an end portion of the upper surface of the lift plate on a downstream side in a sheet feed direction, at a central portion of the upper surface in a width direction, and configured to support a lower surface of the sheets stacked on the lift plate at a position higher than the upper surface of the lift plate, the width direction being perpendicular to the sheet feed direction, wherein the lift attachment includes:

a base portion formed to extend along the sheet feed direction, and smaller than the lift plate in size in the width direction; and a pair of arm portions respectively formed to extend from an end portion of the base portion that is on the downstream side in the sheet feed direction, to opposite directions in the width direction, along an edge of the lift plate that is on the downstream side in the sheet feed direction, the pair of arm portions are formed symmetrically with respect to the base portion in the width direction, and the base portion and the pair of arm portions support the sheets from below.

2. An image forming apparatus comprising:

the sheet storage device according to claim 1;

a sheet feed portion configured to feed the sheets stored in the sheet storage device one by one into a sheet conveyance path; and an image forming portion configured to form an image on a sheet fed into the sheet conveyance path.

3. The image forming apparatus according to claim 2, further comprising:

a pick-up roller configured to rotate upon contact with an upper surface of the sheets in the case, thereby feeding a sheet from the case, wherein the base portion is smaller than the pick-up roller in size in the width direction.

4. The image forming apparatus according to claim 3, wherein the pair of arm portions in the extension position are larger than the pick-up roller in size in the width direction.

5. A sheet storage device storing sheets that are fed by a sheet feed portion, the sheet storage device comprising:

a case storing the sheets;

a lift plate provided on a bottom plate of the case in such a way as to be lifted and lowered, and configured to push up the sheets stacked on an upper surface of the lift plate toward the sheet feed portion that is provided above; and a lift attachment fixed, in a detachable manner, to an end portion of the upper surface of the lift plate on a downstream side in a sheet feed direction, at a central portion of the upper surface in a width direction, and configured to support a lower surface of the sheets stacked on the lift plate at a position higher than the upper surface of the lift plate, the width direction being perpendicular to the sheet feed direction, wherein the lift attachment includes:

a base portion formed to extend along the sheet feed direction, and smaller than the lift plate in size in the width direction; and a pair of arm portions respectively formed to extend from an end portion of the base portion that is on the downstream side in the sheet feed direction, to opposite directions in the width direction, along an edge of the lift plate that is on the downstream side in the sheet feed direction, and the pair of arm portions are supported by the base portion in such a way as to pivot between a folded position in which the arm portions are folded along both side edge portions of the base portion respectively, and an extension position in which the arm portions respectively extend in opposite directions from the end portion of the base portion along the width direction.

6. The sheet storage device according to claim 5, wherein the pair of arm portions in the extension position support an edge of the sheets on the downstream side in the sheet feed direction.

7. The sheet storage device according to claim 5, wherein an attachment housing portion in which the lift attachment is housed, is formed in a frame portion provided outside a sheet storage space in the case, and the lift attachment is housed in the attachment housing portion in a state where the pair of arm portions are in the folded position.

8. The sheet storage device according to claim 5, wherein the base portion is substantially rectangular parallelepiped-shaped, and the pair of arm portions are rotatably supported via support shafts on corners which are located on the downstream side of the base portion respectively.

9. An image forming apparatus comprising:

the sheet storage device according to claim 5;

a sheet feed portion configured to feed the sheets stored in the sheet storage device one by one into a sheet conveyance path; and an image forming portion configured to form an image on a sheet fed into the sheet conveyance path.

10. An image forming apparatus comprising:

a sheet storage device storing sheets that are fed by a sheet feed portion, the sheet storage device comprising:

a case storing the sheets;

a lift plate provided on a bottom plate of the case in such a way as to be lifted and lowered, and configured to push up the sheets stacked on an upper surface of the lift plate toward the sheet feed portion that is provided above; and a lift attachment fixed, in a detachable manner, to an end portion of an upper surface of the lift plate on a downstream side in a sheet feed direction, at a central portion of the upper surface in a width direction, and configured to support a lower surface of the sheets stacked on the lift plate at a position higher than the upper surface of the lift plate, the width direction being perpendicular to the sheet feed direction;

a sheet feed portion configured to feed the sheets stored in the sheet storage device one by one into a sheet conveyance path;

an image forming portion configured to form an image on a sheet fed into the sheet conveyance path; and a pick-up roller configured to rotate upon contact with an upper surface of the sheets in the case, thereby feeding a sheet from the case, wherein the lift attachment includes:

a base portion formed to extend along the sheet feed direction, and smaller than the lift plate in size in the width direction; and a pair of arm portions respectively formed to extend from an end portion of the base portion that is on the downstream side in the sheet feed direction, to opposite directions in the width direction, along an edge of the lift plate that is on the downstream side in the sheet feed direction, and the base portion is smaller than the pick-up roller in size in the width direction.

* * * * *